United States Patent [19]

Foster

[11] 4,065,955

[45] Jan. 3, 1978

[54] METHOD AND APPARATUS FOR FORMING A UNIFORM FELTING NEEDLE BARB

[75] Inventor: Edson Perkins Foster, Cato, Wis.

[73] Assignee: Foster Needle Company, Inc., Manitowoc, Wis.

[21] Appl. No.: 689,393

[22] Filed: June 15, 1976

[51] Int. Cl.[2] ..... B21G 1/06

[52] U.S. Cl. ..... 72/476; 72/359; 28/115

[58] Field of Search ..... 28/4 N; 72/354, 359, 72/476

[56] References Cited

U.S. PATENT DOCUMENTS

| | | | |
|---|---|---|---|
| 2,451,512 | 10/1948 | Rice | 72/354 |
| 3,566,663 | 3/1971 | Zocher | 28/4N |

*Primary Examiner*—Lowell A. Larson
*Attorney, Agent, or Firm*—Francis J. Bouda

[57] ABSTRACT

A felting needle, with thousands of its counterparts, must be identically reproducible and uniform so that consistent duplication of the finished product of felted material is possible. The method of the present invention, as well as the apparatus of this invention for practicing the method, have the capability, for the first time, of exact duplication of a felting-needle barb, with rounded contours on all faces and edges which contact the fibers, and with uniform size, shape and finish, all produced by a method which is essentially a one-step process reducing the number of steps of the manufacturing procedure to a minimum. Thus the apparatus and process provide a barb-forming tool which has a recess or cavity formed therein which is the exact mirror image or mating counterpart of the shape or outline of the barb and barb-recess to be formed in the needle, and which, with such contour-controlling and material-constraining cavity, produces an exact cavity, throat and barb each time the tool strikes the needle. Moreover, the complete forming of the throat and barb, including the depth, barb angle, face width, face angle, kickup (if any) and radii on the edges of the adjoining surfaces is accomplished simultaneously, in a single stroke of the forming tool.

4 Claims, 7 Drawing Figures

Fig. 6
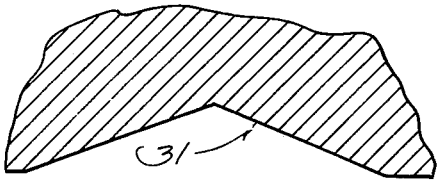
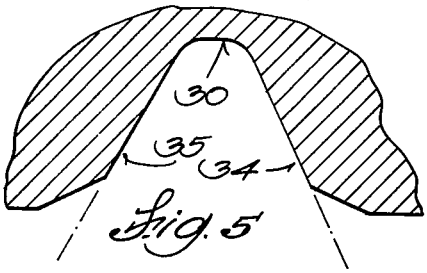
Fig. 5
Fig. 4
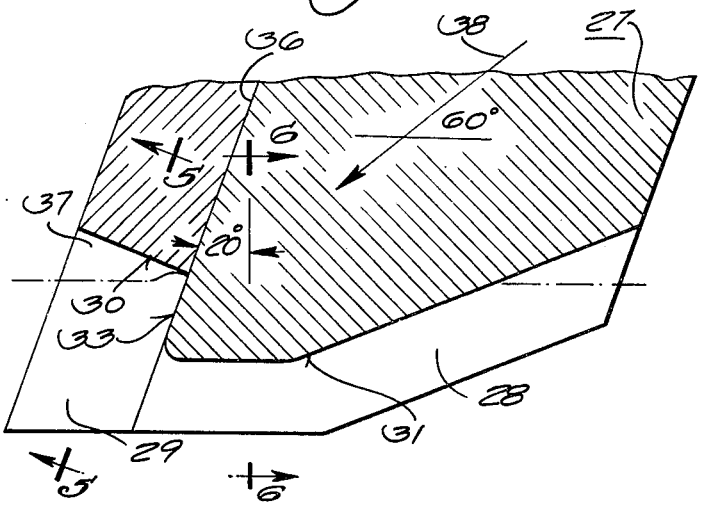
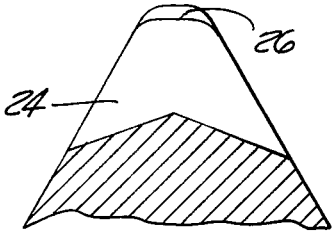
Fig. 3
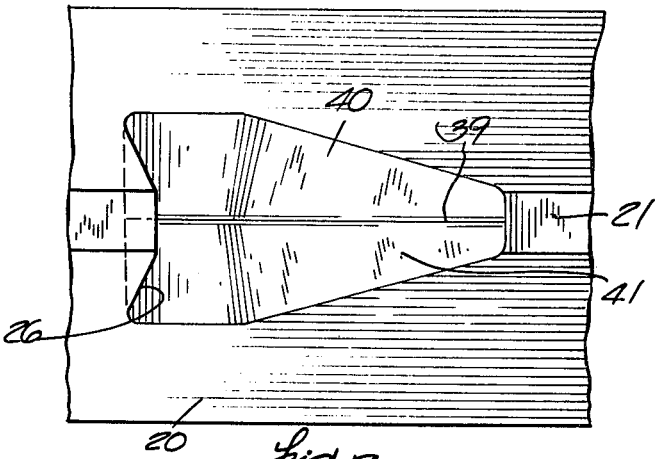
Fig. 2
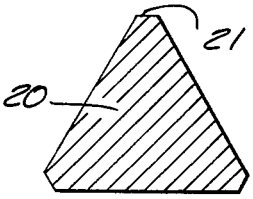
Fig. 7
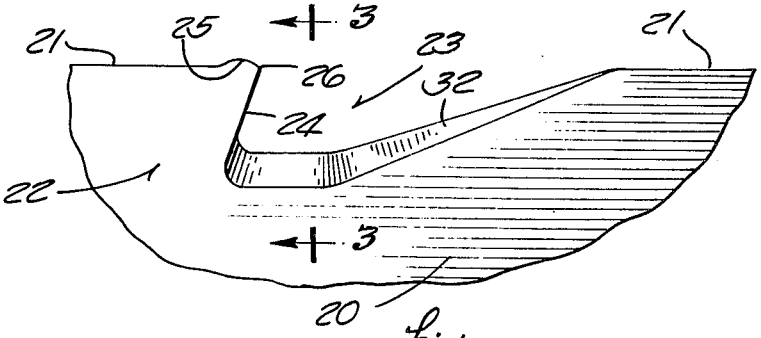
Fig. 1

METHOD AND APPARATUS FOR FORMING A UNIFORM FELTING NEEDLE BARB

BACKGROUND OF THE INVENTION

Barb forming tools and the process of their use, for creating in the blade of a felting needle an efficient barb, are not new, and I refer particularly to my prior U.S. Pats. Nos. 3,307,238; 3,844,004; and 3,641,636. Such tools and procedures, however, require the application of several different steps or procedures, including the smoothing or finishing step, and several different tools or machines to complete the cavity with its throat and barb. The multiple tool procedure could not provide uniformity and duplication of the barbs, thus minimizing the ability of the user of the needle to control his finished product. Therefore, in the past, where separate barbing, shaping, and kickup dies have been required (each step, or the final step, may have required a subsequent smoothing operation to remove sharp edges or burrs which would tend to cut the fibers) it is understandable that the cost of the needles was high because of the excessive manufacturing time and labor required. But more critically, none of the past tools and processes have been able to constrain and control the blade and barb material to provide identical barbs, and for the first time I am able to form a felting needle with uniform perimeter contours because I control the lateral formation during the swaging operation.

SUMMARY OF THE INVENTION

In the present invention of the tool and process for formimg the cavity, throat and barb of an improved needle, I provide a barb-forming tool which has a recess formed therein and such recess is the female or mirror image or mating counterpart of the surface contours, envelope, edges and perimeters of the barb and throat to be formed in the needle. The tool forces the blade material to conform to the inner configuration of the cavity to provide barb face perimeter contours which are uniform and undistorted.

The tool strikes the blade at the proper angle, and, in a single stroke, moves the material downwardly and backwardly from the point of impact to create the throat of the barb having precise surfaces, edges and dimensions, and at the same time causes the material of the blade to flow into the barb area. Some of the material moves upwardly to create the spur of the barb while the tool controls the amount of movement and dimensions of the spur and barb and kickup so that a precise barb with exact face, kickup, face angle and barb angle are produced in what I have chosen to call a swaging operation or coining operation.

This tool and process are thus able to form an exact barb and consistently duplicate such barb each time the tool is applied to the blade of the needle. It is immaterial whether the needle is a triangular one, or a pinch-blade needle following the teachings of my prior patents or of the prior art, and it is immaterial whether the angles of the blade faces are sharp or include a ridge. I am, with this tool and process, able to form the throat and barb exactly the same at each stroke of the tool, and additionally, each such forming step, in its entirety, is a single stroke which eliminates multiple steps and finishing operations, and thus materially reduces the cost of the needles as well as the subsequent needling operation.

A principal object is to provide a tool and a swaging process of forming a felting needle barb in one step by controlling the lateral formation during the swaging operation.

A further object of this invention is to provide a barb-forming tool wherein the shaping recess of the tool is an exact counterpart in shape, outline and dimensions of the finished barb-and-throat cavity in the needle.

Still another object of the present invention is to reduce the cost of manufacturing felting needles.

Another object of the present invention is to provide a tool and process for exactly and identically reproducing felting needles, and particularly the barbs thereof.

With the above and other objects in view, a more complete understanding of the present invention can be achieved by referring to the following detailed description.

DETAILED DESCRIPTION

For the purpose of illustrating the invention, there is shown in the accompanying drawings a form thereof which is at present preferred, although it is to be understood that the various instrumentalities of which the invention consists can be variously arranged and organized and that the invention is not limited to the precise arrangements and organizations of the instrumentalities as herein shown and described.

In the drawings, wherein like reference characters indicate like parts:

FIG. 1 represents a side-elevational view of the barb of the present invention shown in a fragmentary portion of a felting needle.

FIG. 2 represents a top plan view of the barb of the present invention also shown in a fragmentary portion of a felting needle.

FIG. 3 is a vertical cross-sectional view taken generally along line 3—3 of FIG. 1.

FIG. 4 is a vertical cross-sectional view of the barb-forming tool of the present invention.

FIG. 5 is a vertical cross-sectional view taken generally along line 5—5 of FIG. 4.

FIG. 6 is a vertical cross-sectional view taken generally along line 6—6 of FIG. 4.

FIG. 7 is a vertical cross-sectional view of the blade portion of a felting needle to which the barb of the present invention may be applied.

Felting needles 20 to which the present invention may be applied are usually angular in cross-section and may be triangular, as shown in FIG. 7, or any other irregular shape such as the commonly identified "pinch-blade" needle. Such blades 20 have a plurality of ridge-like surfaces 21 disposed axially along the surface thereof, into which ridges a plurality of barbs may be formed. One such barb is shown at 22 in FIG. 1.

Customarily, such barbs include a throat portion 23, a face 24, and a kickup 25. The kickup 25 provides an upstanding surface including the face 24 and the edge 26 which extends slightly above the surface of the ridge 21, to engage fibers of the material to be felted as the needle 20 is forced into the material, catching such fibers against the face 24 and in the throat 23.

In order to form the barb 22 so that all surfaces thereof are streamlined and smoothly contoured and identical, one barb to the next, I have formed the barb-swaging tool 27 shown in FIG. 4. This swaging tool includes a barbing section 28 and a kickup portion 29. The barbing portion and the kickup portion may be integral, but I prefer to form them of separate portions as shown in FIG. 4, not only because they have separate cross-sectional profiles, as shown in FIGS. 5 and 6, but also so that the relative disposition of the striking face 30 of the kickup portion 29 can be adjusted, as desired, with regard to striking face 31 of the swaging portion 28 so as easily to provide a control for the height of the kickup 25 on the barb 22.

The undersurface 30 of the kickup portion 29, as well as the undersurface 31 of the barbing portion 28 have contoured faces providing a recess or cavity which is generally saddle-like in configuration, as shown particularly in FIGS. 5 and 6. These surfaces 30 and 31, when brought forcefully against the ridge 21 of a needle 20, create a complementary throat, face and barb in the needle as is showh both in FIGS. 1 and 4. The surface 31 of the barbing or swaging portion 28 creates the throat 23 with the surface 32 precisely, uniformly and smoothly conforming to the undersurface 31 in the swaging portion 28. Moreover, the facing surface 33 of the barbing porton 28 forms the face 24 at the same time, with the surfaces and edges of the face 24 and the throat 23 smoothly and uniformly blending into each other.

As the swaging tool 27 is brought against the needle, the undersurface 30 of the portion 29 precisely defines the kickup 25 with the undersurface portions 34 and 35 forming, positioning and controlling the location of the edge 26 in the kickup 25.

As can be seen particularly in FIG. 4, the surface 30 of kickup portion 29 is disposed at a 90° angle to the surface 33 (and also to the mating line 36 between the swaging portion 28 and the kickup portion 29). This angle of 90° may be varied as desired to define and control the angle of the top of the kickup with regard to the face 24.

Additionally, the disposition of the surface 30 in the kickup portion 29 not only permits the needle material to flow upwardly from the throat (where it has been displaced) into the kickup 25, against the undersurfaces 30, 34 and 35, but the relief portion 37 provides an area into which the excess material may flow, after having been controlled by the surfaces 30, 34 and 35 so that the height of the kickup, the disposition of its edge 26, and the top surface may be precisely reproduced from barb to barb.

Although I have shown a barb with a face disposed at approximately 20° to a plane at right angles to the major axis of the needle, as shown in FIG. 4, it is to be understood that the swaging tool may be formed so that another angle, as desired, is created in the face, as for instance, 5°, 10°, or even a negative angle. Moreover, in operation the swaging tool 27 may be brought against the needle at an angle which is not at all the same as the angle of the mating line 36, and I have shown an arrow 38 in FIG. 4 which indicates the angle of attack of the tool against the needle, and this may be between 50° to 60° to the major axis of the needle.

As is shown also in FIG. 2, the throat 23 may have a generally central ridge or dividing line 39 in the surface 32 thereof, separating the two face portions 40 and 41, more effectively to provide a downwardly sloping surface over which the fiber may drape, thus reducing damage to the fiber.

With reference to FIG. 3, one can see that the face 24 is flat, providing an upwardly and outwardly converging acute angled configuration in the barb.

Thus I have created a streamlined barb with a single stroke of the swaging tool 27. By a single stroke I do not mean to exclude a plurality of rapidly repetitive striking actions which will help the material flow during the swaging process, but mean to distinguish it from separate strokes or applications of separate tools, such as been the practice in the past wherein a barbing die first creates the throat, a second die may control the height of the kickup, a third pinching die may control the width of the barb, a fourth die may smooth the edges etc. Thus a single swaging tool having a precisely formed cavity formed in the undersurface thereof, defines an envelope or perimeter which creates an exactly mating recess or throat, cavity or depression in the needle, including barb, kickup and throat all in one application of the swaging tool to the needle.

By a swaging tool I mean to include any tool used for shaping metal where the tool is held against the metal to be worked, and force applied to the tool to shape the material, and thus it may include coining, moulding or flowing, as well as swaging in its application.

Where I refer to a cavity in the die, this is meant to include any recess which may be saddle-shaped or concave or otherwise formed to provide the female mating portion of the interacting tool and needle, and though the swaging die creates a depression, cavity or throat 23 in the needle, which is shown particularly in FIG. 1, nevertheless at the time that the needle and swaging tool are in contact with each other the material of the needle provides the precise and exact male mating counterpart in its surfaces of throat, face and barb to match the female restraining, coining and shaping portions of the swaging die.

Thus I have, by appropriately shaping alll of the surfaces of the swaging portion and the kickup portion, precisely predetermined the configuration and shape of the throat and barb to be shaped thereby, and therefore can reproduce exactly all depressions and projections, surfaces, contours, shapes, mating edges and dimensions of the throat, face and barb, and thus exactly reproduce such barb time after time with such swaging tool, in various positions on one needle, or from needle to needle.

Moreover, I have eliminated any burrs or sharp edges, unnecessary bulging of material, any imprecise dimensions of the throat, any irregularities or indirections in the disposition of the barb on the needle, and can thus provide, for the first time in this complex art, a felting needle which offers the qualities, controls and uniformities heretofore unavailable to the user of such needles.

I particularly point out that by the two-part design of the swaging tool, as shown in FIG. 4, the complex and otherwise compound curves of the swaging portion and kickup portion can be machined easily and developed, can be modified or replaced as desired, if damaged in use, and can be readily changed to accomodate different heights of kickup and angle of tip as the customer selects, and thus provide a less expensive tool and process for forming a needle than has heretofore been found possible.

Having thus described my invention, what I claim as new and desire to protect by letters patent are the following:

1. A tool for forming a barb in the blade of a felting needle, said tool including a swaging member having a throat-defining portion, a spur-defining portion, a face-forming portion, and a kickup controlling portion, said portions providing a cavity in the tool with the face-forming portion disposed between the throat-defining portion and the spur-defining portion and against which cavity the needle-blade material flows when in use whereby to create, in the fiber-engaging surfaces of a felting needle, a throat and a barb defined precisely by the outline of the cavity, said portions have smoothly contoured meeting edges between adjacent surfaces and having precisely determined angles therebetween so that the blade material of the needle completely fills and substantially fully conforms to the shape and outline of the cavity adjacent the throat-, spur-, and face-defining portions, but flows freely in and only partially fills the kickup-controlling portion.

2. The tool of claim 1 wherein the spur-defining portion and the throat-defining portion are a unitary structure.

3. The tool of claim 1 wherein the spur-defining portion and the throat-defining portion are moveable relative to each other.

4. The tool of claim 1 wherein the kickup-controlling portion includes an area which contains in precise outline and configuration the blade material forced thereinto, and also a non-restricting area rearwardly of the kickup into which the blade material may freely flow during the swaging action of the tool against the blade.

* * * * *